United States Patent [19]

Chihana

[11] Patent Number: 5,074,183

[45] Date of Patent: Dec. 24, 1991

[54] MUSICAL-TONE-SIGNAL-GENERATING APPARATUS HAVING MIXED TONE COLOR DESIGNATION STATES

[75] Inventor: Masanobu Chihana, Hamamatsu, Japan

[73] Assignee: Yamaha Corporation, Hamamatsu, Japan

[21] Appl. No.: 415,104

[22] Filed: Sep. 29, 1989

[30] Foreign Application Priority Data

Oct. 1, 1988 [JP] Japan ..... 63-248611

[51] Int. Cl.[5] ..... G10H 1/08; G10H 1/24

[52] U.S. Cl. ..... 84/615; 84/622; 84/659

[58] Field of Search ..... 84/622–625, 84/686, 620, 644, 654–656, 670, 343, 345

[56] References Cited

U.S. PATENT DOCUMENTS 3,823,390 7/1974 Tomisawa ..... 340/172.5
4,300,435 11/1981 Schmoll ..... 84/DIG. 9
4,358,980 11/1982 Imamura ..... 84/620
4,538,495 9/1985 Sato ..... 84/622

*Primary Examiner*—William M. Shoop, Jr.
*Assistant Examiner*—Brian Sircus
*Attorney, Agent, or Firm*—Spensley Horn Jubas & Lubitz

[57] ABSTRACT

A musical-tone-signal-generating apparatus which determines the current tone-color-designation state on the basis of the operation of one or more tone-color-selection switches, reads from a memory tone-color-control information that specifies the tone colors corresponding to the current tone-color-designation state, and controls the generation of musical-tone signals on the basis of the tone-color-control information. The tone-color-control information includes various data necessary for generating one or more tone colors selected by the tone-color-selection switches. Thus, the apparatus can generate a plurality of tone colors simultaneously with a simple configuration.

14 Claims, 4 Drawing Sheets

(CONFIGURATION OF ELECTRONIC MUSICAL INSTRUMENT)

FIG. 1 (CONFIGURATION OF ELECTRONIC MUSICAL INSTRUMENT)

(DATA FORMAT IN ROM)

(ARRANGEMENT OF REGISTERS IN RAM)

(ARRANGEMENT OF REGISTERS IN RAM)

MUSICAL-TONE-SIGNAL-GENERATING APPARATUS HAVING MIXED TONE COLOR DESIGNATION STATES

BACKGROUND OF THE INVENTION

1. Field of the Invention

The present invention relates to a musical-tone-signal-generating apparatus, and more particularly, to a tone-color-selecting technique for the apparatus.

2. Prior Art

Among conventional electronic organs which can simulate a pipe organ, a type provided with a number of tone-selecting switches called "flute-couplers" is known. Each of these tone-selecting switches, for example, corresponds to one of the following foot-sounds: 1', 2', 4', 5(1/3)', 8', and 16'.

In the above-mentioned electronic organ, a plurality of the tone-selecting switches can be simultaneously turned on, so that a plurality of foot-sounds corresponding to the on-switches can be generated simultaneously. In order to generate a number of foot-sounds, a plurality of musical-tone-generating channels must be provided in a parallel fashion or in a time-sharing fashion. As a result, the number of the musical-tone-generating channels increases with the number of tones simultaneously generated, and consequently, the configuration of the apparatus becomes more complex and cost increases.

To overcome these problems, another technique is proposed (for example, see U.S. Pat. No. 3,823,390). This technique produces musical-tone waveforms to be generated by computation each time a number of tone colors are selected, and the resultant waveforms are stored into wave memories. The computation above is performed on the basis of the volume-level information and the musical-tone-spectrum information corresponding to the selected tone colors. According to the technique, though the number of the wave memories can be reduced, the circuit configuration for computing the waveforms must remain complex.

A similar problem occurs not only in the tone-color selection of the flute-coupler, but also in other tone-color-selections, such as that of a horn, a bass, or the like. For this reason, it was usual that simultaneous selection of two or more tone colors in the same tone group was inhibited, and only one tone color selected by one of the tone-color-selecting switches of each tone group was allowed.

SUMMARY OF THE INVENTION

It is therefore an object of the present invention to provide a musical-tone-signal-generating apparatus of a simple configuration that can simultaneously generate a plurality of tone colors.

In one aspect of the present invention, there is provided a musical-tone-signal-generating apparatus comprising:

(a) tone-color-designation means for designating one or more tone colors from a plurality of different tone colors;

(b) determination means for determining a tone-color-designation state designated by the tone-color-designation means each time the designation of one or more tone colors is carried out, and outputting state information representing the determined tone-color-designation state;

(c) storing means for storing tone-color-control information corresponding to each of the tone-color-designation states;

(d) reading means for reading out the tone-color-control information corresponding to the determined tone-color-designation state from the storing means by using the state information supplied from the determination means; and (e) tone-generating means for generating musical-tone signals corresponding to the determined tone-color-designation state on the basis of the tone-color-control information read from the storing means.

In a more specific aspect of the present invention, there is provided a musical-tone-signal-generating apparatus wherein the tone-color-designation means has restriction means for restricting the number of tone colors that can be simultaneously designated to a value less than the total number of the tone colors that can be designated by the tone-color-designation means.

According to the present invention, when one or more tone colors are designated by the tone-color-designation means, the tone-color-control information corresponding to the tone-color-designation state is read from the storing means, and is sent to the tone-generating means. On the basis of this tone-color-control information, the tone-generating means produces musical-tone signals corresponding to the tone-color-designation state. As a result, the tone-generating means need not be provided with a number of musical-tone-generating channels in a parallel fashion or in a time-sharing fashion. Thus, the configuration of the apparatus may be made simpler. In addition, undesired tone volume augmentation owing to the mixing of a number of musical-tone signals does not occur, because the mixing is not necessary.

Moreover, complicated processes, such as computation of waveforms, are not required because the tone-color-control information, which is prestored in the storing means for each possible tone-color-designation state and is used for the generation of musical tones, is read from the storing means according to the designation by the tone-color-designation means, and is sent to the tone generating means to produce the musical-tone signals of the designated tone colors.

Furthermore, according to a more specific aspect of the invention, the restriction means makes it possible to reduce the memory capacity of the storing means, as well as reduce the number of tone colors of the tone-generating means.

DESCRIPTION OF THE PREFERRED EMBODIMENTS

The invention will now be described with reference to the accompanying drawings.

[A] FIRST EMBODIMENT

Figure 1:
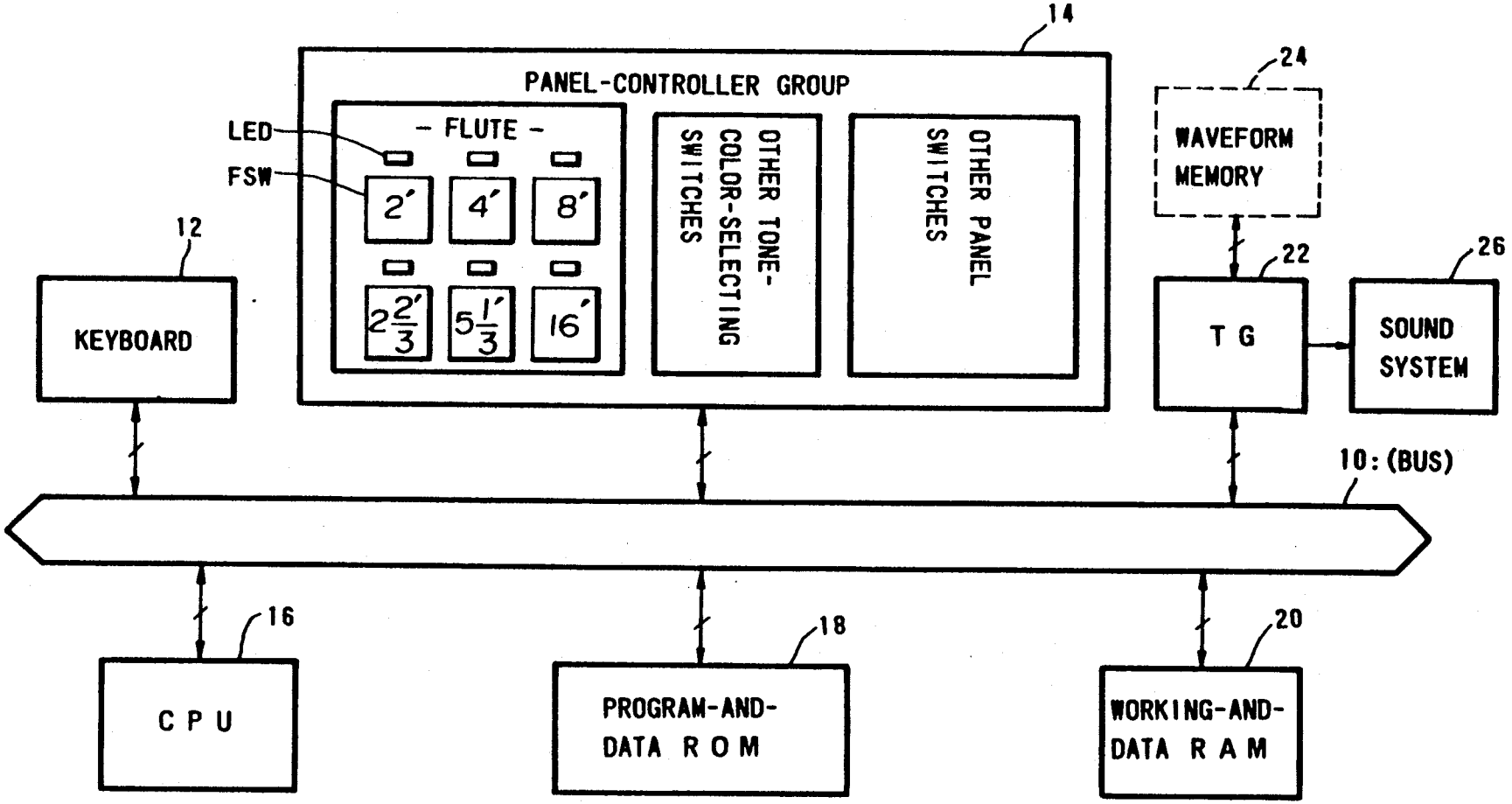
FIG. 1 is a block diagram of an electronic musical instrument according to an embodiment of the present invention.

FIG. 1 is a block diagram of an electronic musical instrument according to an embodiment of the present invention. This electronic musical instrument controls the generation of musical tones by means of a microcomputer.

CONFIGURATION

In FIG. 1, bus 10 interconnects a keyboard 12, a panel-controller group 14, central-processing unit (CPU) 16, program-and-data ROM (Read-Only Memory) 18, working-and-data RAM (Random-Access Memory) 20, and tone generator 22.

Keyboard 12 is provided with various keys for manual performance, and operating-key information is detected for each key.

Panel-controller group 14 includes three groups of switches: tone-color-selection switches FSW which are composed of 6 push-button switches and work as a flute-coupler; other tone-color-selection switches for selecting a tone color such as piano, violin, trumpet, etc.; and other panel switches for setting tone volume, vibrate, chorus, brilliance, etc. Each of the 6 tone-color-selection switches FSW corresponds to one tone-footage of 2', 2(2/3)', 4', 5(1/3)', 8', 16', and is provided with a light-emitting diode (LED) adjacent thereto.

CPU 16 executes various processes to generate musical tones according to the programs stored in a program-storing area of ROM 18. These processes will be described later with reference to FIG. 4 to FIG. 6.

Figure 2:
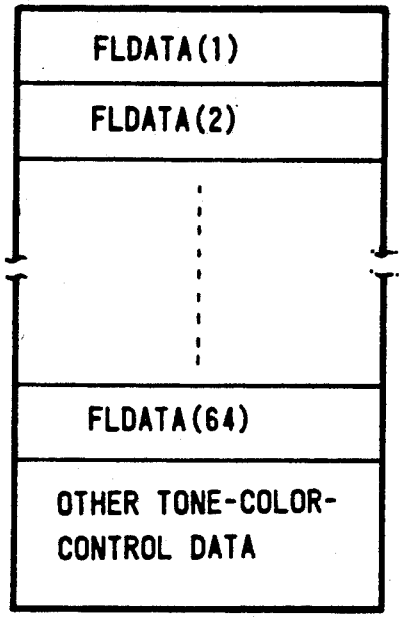
FIG. 2 is a table showing a data format in the ROM of the embodiment.

ROM 18 includes a tone-color-control-data-storing area in addition to the program-storing area. The tone-color-control-data-storing area stores 64 items of tone-color-control data FLDATA(1) to FLDATA(64) as shown in FIG. 2, and other tone-color-control data corresponding to a piano, a violin, a trumpet, etc. Each of the tone-color-control data FLDATA(1) to FLDATA(64) corresponds to one of the 64 ($=2^6$) tone-color-designation states specified by the combinations of 6 tone-color-selection switches FSW. These combinations are made by selecting either one tone-color-selection switch FLDATA (called single operation), or more than one tone-color-selection switch FLDATA (called combined operation). In addition, the combination can include the case in which no tone-color-selection switch FLDATA is turned on. Such a combination can be omitted, or can be used to designate one of the tone colors of a flute as an initial state just after the power is turned on.

The tone-color-control data are necessary for tone generator 22 to generate musical tones corresponding to the state selected from the 64 tone-color-designation states. The content of the tone-color-control data depends on the tone-generating type of tone generator 22: a frequency-modulation (FM) type tone generator requires tone-color-control data composed of amplitude-envelope data, and a set of modulation-control parameters for specifying harmonic components; a harmonic-synthesizing type tone generator requires tone-color-control data for specifying a set of harmonic coefficients to define the spectra of musical tones; a waveform-reading type tone generator requires tone-color-control data for designating addresses of musical tone waves to be read out. Two or more of these types of tone generators can be combined to generate musical tones. For example, at the attack portion of musical sounds, the FM-type generates the sounds, while at the sustain portion thereof, the waveform-reading-type generates the sound. In such a case, tone-color-control data must be changed according to the combination of the tone generators.

Figure 3A:
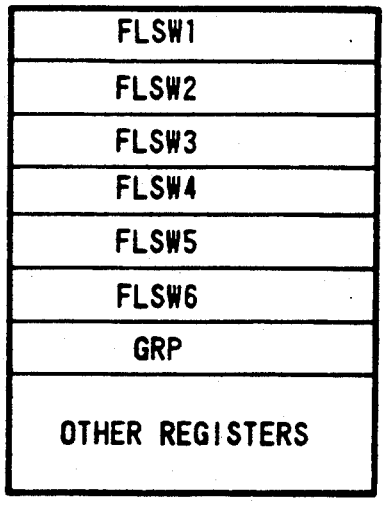
FIGS. 3A and 3B are tables showing an arrangement of registers in the RAM of the embodiment.

RAM 20 includes registers used in the processes of CPU 16. FIG. 3A shows the registers used in the first embodiment.

First, registers FLSW1 to FLSW6 are switch-state flags, each of which corresponds to each of the tone-color-selection switches FSW of 1', 2', 2(2/3)', 4', 5(1/3)', 8', 16'. Each of these switch-state flags is set to "1" or "0" alternately each time the corresponding switch FSW is turned on. Second, register GRP is a state-number register which stores one of the state numbers 1 to 64 corresponding to 64 items of the tone-color-designation states.

Tone generator 22 generates musical tone signals according to a tone-generating type described above. When the tone generator of a waveform-read-out type is used, waveform memory 24 is provided for storing musical-tone-waveform data corresponding to the 64 tone-color-designation states.

Musical tone signals produced from tone generator 22 are sent to sound system 26 having output amplifiers and speakers, and are produced as musical sounds.

MAIN ROUTINE

Figure 4:
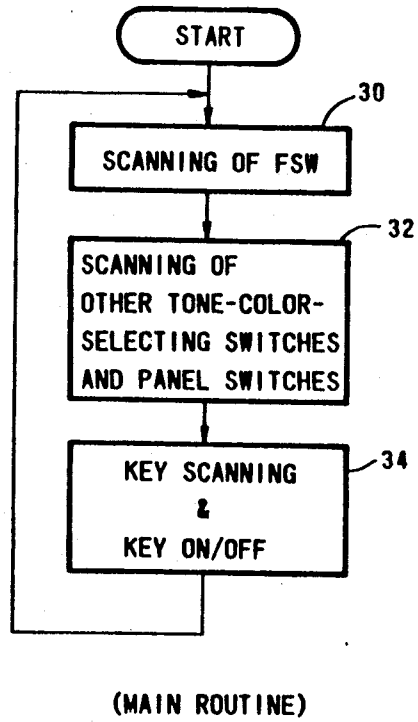
FIG. 4 is a flowchart of the main routine of the embodiment.

FIG. 4 is a flowchart of the main routine of the program processed by CPU 16. The main routine starts, for example, when the power is turned on.

At step 30, CPU 16 scans 6-tone-color-selection switches FSW. When an event is detected in one of the 6-tone-color-selection switches FSW, CPU 16 transfers to the subroutine shown in FIG. 5.

At step 32, CPU 16 scans the tone-color-selection switches and panel switches other than tone-color-selection switches FSW, and sets tone colors or tone volume, etc. when at least one of these switches causes an event.

At step 34, CPU 16 scans keyboard 12, and carries out a key-on/off process each time a key event is detected in one of the keys. More specifically, when a key event is due to the depression of a key, CPU 16 sends the keycode of the depressed key to tone generator 22 to start generating musical tones, whereas when a key event is due to the key release, CPU 16 commands tone generator 22 to start attenuation of the musical tone of the released key.

After step 34, CPU 16 loops back to step 30 to repeat the above processes.

FSW-ON SUBROUTINE

Figure 5:
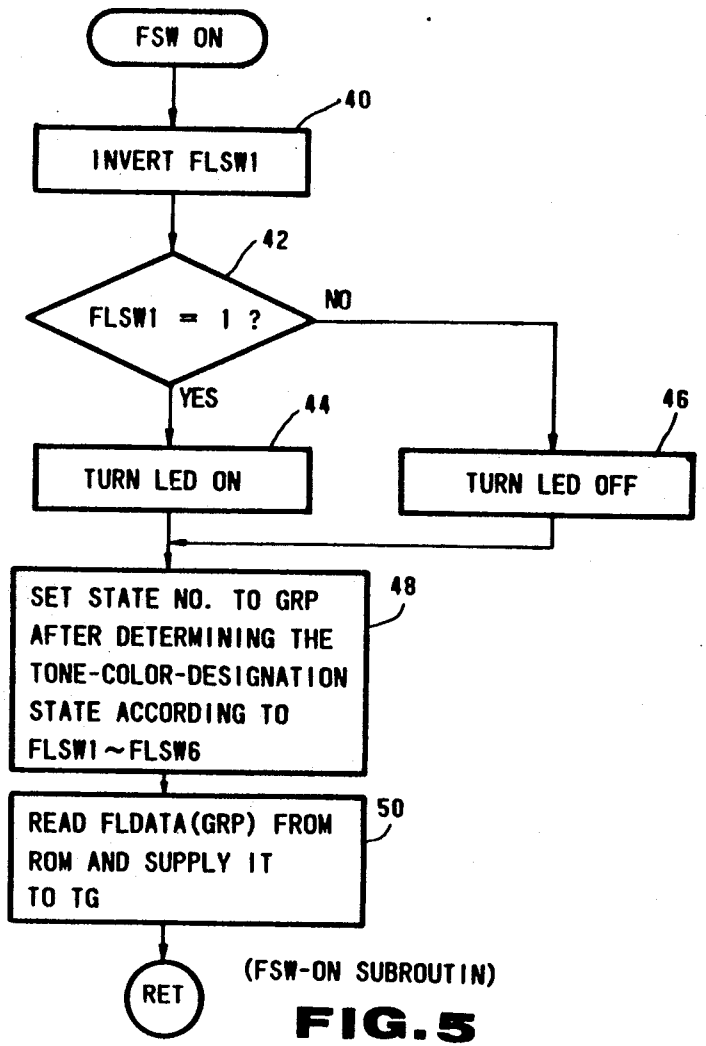
FIG. 5 is a flowchart of the FSW-on subroutine of the embodiment.

FIG. 5 is a flowchart of the FSW-on subroutine which is carried out when an on-event is detected in one of the tone-color-selection switches FSW. In FIG. 5, steps 40 to 46 show the processes when an on-event occurs in tone-color-selection switch FSW of 2'. On-events of the other tone-color-selection switches FSW are processed in a similar manner, and so the drawing and description thereof will be omitted.

At step 40, the content of FLSW1 is inverted, that is, FLSW1 of "0" is set to "1", and FLSW1 of "1" is set to "0". Thus, the content of FLSW1 alternatively changes every time the tone-color-selection switch FSW of 2' is depressed. After that, CPU 16 transfers to step 42.

At step 42, CPU 16 tests if FLSW1 is "1" or not. If the test result is positive (Y), CPU 16 transfers to step 44, and turns on the LED corresponding to switch FSW of 2'. In contrast, if the test result is negative (N), CPU 16 moves to step 46, and turns off the LED corresponding to switch FSW of 2'. Completing step 44 or 46, CPU 16 transfers to step 48, and sets the state number corresponding to the tone-color-designation state into register GRP. This is achieved by making a judgement on the basis of FLSW1 to FLSW6 as to which of the 64-tone-color-designation states the current state occupies. After that, CPU 16 moves to step 50.

At step 50, CPU 16 reads from ROM 18 tone-color-control data FLDATA(GRP) corresponding to the state number stored in register GRP, and sends the read data to tone generator 22. As a result, tone generator 22 sets the single tone color or combined tone colors according to the tone-color-designating state designated by tone-color-selection switches FSW.

After step 50, CPU 16 returns to the main routine shown in FIG. 4.

Although the electronic musical instrument of the first embodiment can generate musical tones of a plurality of tone colors simultaneously, it requires only one musical-tone-generating channel. In addition, it requires no computation of waveforms. Thus, the configuration of the embodiment is simpler than a conventional apparatus, and consequently the cost thereof can be decreased.

[B] SECOND EMBODIMENT

Figure 3B:
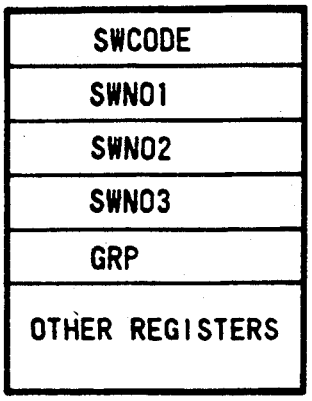
Figure 6:
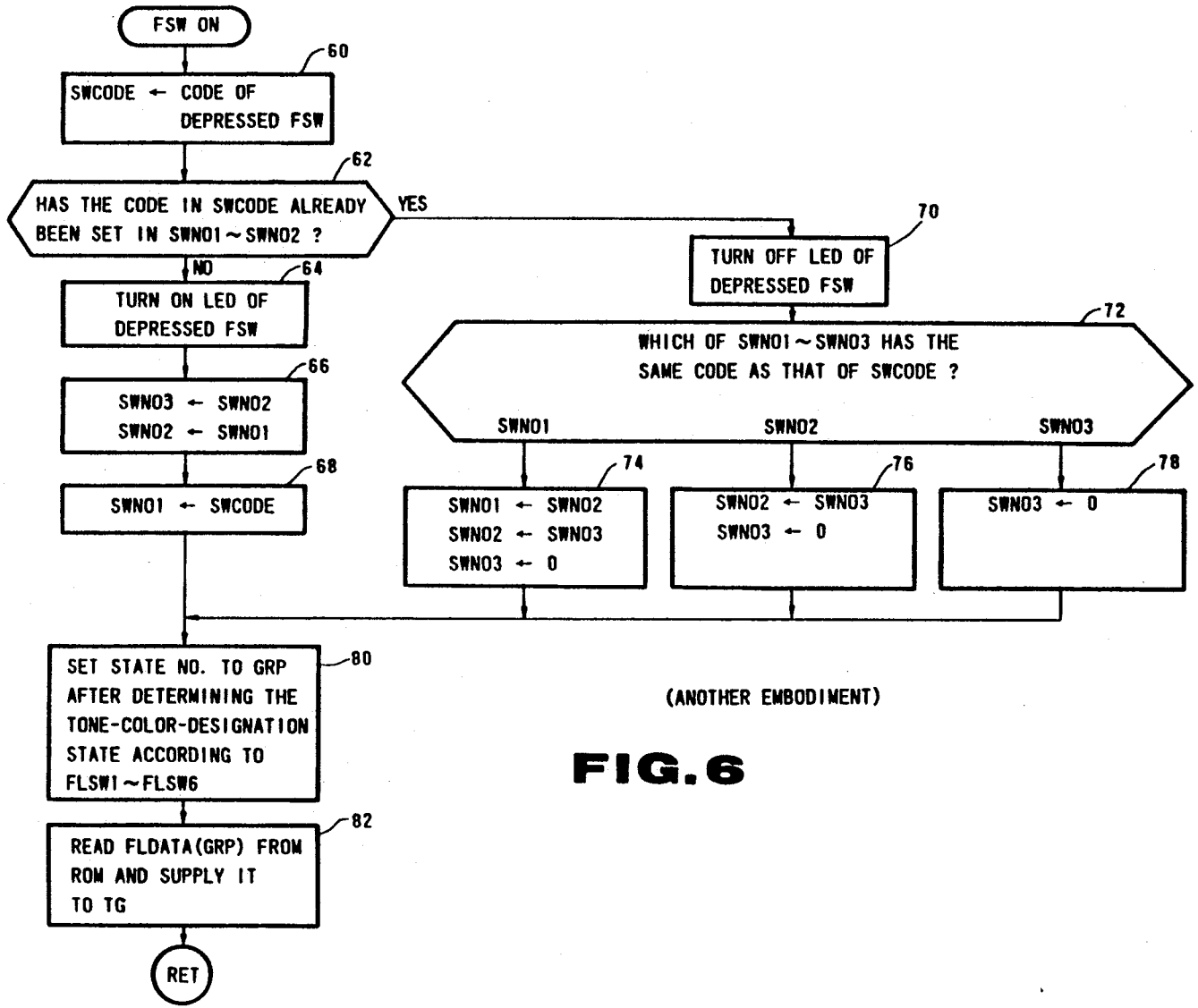
FIG. 6 is a flowchart of the FSW-on subroutine of another embodiment of the present invention.

The second embodiment differs from the first embodiment in that the second embodiment has the registers shown in FIG. 3B instead of the registers shown in FIG. 3A, and carries out the FSW-on subroutine in FIG. 6 instead of the subroutine in FIG. 5. In the second embodiment, the number of tone-color-selection states can be reduced.

FIG. 3B shows the registers of the second embodiment of the present invention. First, register SWCODE is a switch-code register to which the code of a selected switch is set each time one of the 6 tone-color-selection switches FSW is manipulated. Second, registers SWNO1 to SWNO3 are operation-sequence registers which are provided to allow the simultaneous designations of a number of tone colors. This is achieved by storing up to 3 switches most recently operated among the 6 tone-color-selection switches FSW. Register SWNO1 stores the code of the latest operated switch, register SWNO2 stores the code of the second latest operated switch, and register SWNO3 stores the code of the third latest operated switch. Register GRP is a state-number register similar to that shown in FIG. 3A.

FIG. 6 shows the FSW-on subroutine of the second embodiment. In this embodiment, only a maximum of 3 switches of the 6-tone-color-selection switches FSW can be simultaneously selected. In other words, up to 41 ($={}_6C_3+{}_6C_2+{}_6C_1$) items of tone-color-designation states are made, and so tone-color-control data FLDATA(1) to FLDATA(41) corresponding to these 41 items are stored in the tone-color-control-data-storing area in ROM 18. Moreover, the number of tone-color generation relating to the flute-coupler in tone generator 22 can be reduced to 41.

At step 60, CPU 16 scans 6-tone-color-selection switches FSW, sets the code of a switch causing on-event into register SWCODE, and transfers to step 62.

At step 62, CPU 16 tests if the code in register SWCODE has already been set in one of the registers SWNO1 to SWNO3. If the test result is negative (N), this means that a new tone color is chosen which has not yet been selected. After that, CPU 16 moves to step 64.

At step 64, CPU 16 turns on the LED corresponding to the switch manipulated. At step 66 the data in register SWNO2 is transferred into register SWNO3, and the data in register SWNO1 is transferred into register SWNO2. Subsequently, the code in register SWCODE is moved into register SWNO1.

On the other hand, if the test result at step 62 is positive (Y), this means that a switch which has already been selected is turned on again, and so the data corresponding to the switch must be canceled.

In order to achieve this, at step 70, the LED corresponding to the switch manipulated is turned off, and at step 72, registers SWNO1 to SWNO3 are tested to find which one stores the same code as that in register SWCODE. If the register SWNO1 stores the same code as that in register SWCODE, CPU 16 transfers the data in register SWNO2 to SWNO1, the data in register SWNO3 to SWNO2, and sets "0" to register SWNO3 at step 74. If the register SWNO2 stores the same code as that in register SWCODE, CPU 16 transfers the data in register SWNO3 to SWNO2, and sets "0" to register SWNO3 at step 76. If the register SWNO3 stores the same code as that in register SWCODE, CPU 16 sets "0" to register SWNO3 at step 78. In any case, the code of the switch which is turned on is canceled from one of the registers SWNO1 to SWNO3.

Completing step 68, 74, 76, or 78, CPU 16 transfers to step 80. At step 80, CPU 16 tests and determines which of the 41 items of the tone-color-designation states the current tone-color-designation state occupies according to the contents of registers SWNO1 to SWNO3, and sets the state number (one of 1 to 41) corresponding to the determined tone-color-designation state into register GRP.

After that, at step 82, CPU 16 reads tone-color-control data FLDATA(GRP) from ROM 18 in a manner similar to step 50 in FIG. 5, and sends the read data to tone generator 22. Completing step 82, CPU 16 returns to the main routine in FIG. 4.

Since the second embodiment restricts the number of tone colors that can be simultaneously designated, the memory size of tone-color-control-data-storing area, as well as the number of tone colors generated in the tone generator can be reduced. Thus, the apparatus according to the second embodiment is smaller in size and lower in cost than a conventional one.

Although specific embodiments of a musical-tone-signal-generating apparatus constructed in accordance with the present invention have been disclosed, it is not intended that the invention be restricted to either the specific configurations or the uses disclosed herein. Modifications may be made in a manner obvious to those skilled in the art as follows:

(1) Tone colors to be selected are not restricted to those relating to the flute-coupler. They can be more common tone colors such as those of a piano, a trumpet, or the like.

(2) The number of tone-color-selection switches is not defined to be 6; the number can be greater or less than 6.

(3) Although the processes described above are executed by a microcomputer, it can be carried out by special hardware specially designed for the purpose.

(4) Although the selection of tone colors is performed by manual operations in the embodiments above, it can also be done by the following means: automatic selection by using preset operation; selection by the signals sent from a MIDI (Musical Instrument Digital Interface) apparatus; or selection by read-out data from an external memory.

(5) The present invention can be applied to rhythm-performance apparatus to select rhythmic-tone-colors such as those of cymbals, a drum, high-hat cymbals, or tom-tom, etc.

Accordingly, it is intended that the invention be limited only by the scope of the appended claims.

I claim:

1. A musical-tone-signal-generating apparatus comprising:

(a) tone-color-designating means for designating one or more tone colors from a plurality of different tone colors;

(b) determination means for determining a tone-color-designation state corresponding to the combination of tone colors designated by said tone-color-designation means each time said tone-color-designation means designates one or more tone colors, and outputting state information representing the determined tone-color-designation state;

(c) storing means for storing, in advance of activation of said designation means, tone-color-control information corresponding to said tone-color designation states, including tone color information corresponding to combined plural tone colors;

(d) reading means for reading out said tone-color-control information corresponding to said determined tone-color-designation state from said storing means by using said state information supplied from said determination means; and (e) tone-generating means, having a plurality of tone generation channels, for generating musical tone signals corresponding to said determined tone-color-designation state on the basis of said tone-color-control information read from said storing means, wherein said tone-color-designation state may correspond to combined plural tone colors greater in number than said plurality of tone generation channels.

2. A musical-tone-signal-generating apparatus according to claim 1 wherein said tone-generating means is a waveform-reading type in which said tone-generating means is connected with waveform memory means that stores musical-tone-waveform data corresponding to each of said tone-color-designation states, and said tone-color-control information includes address data that designate the addresses of said musical-tone-waveform data.

3. A musical-tone-signal-generating apparatus according to claim 1 wherein said tone-generating means is a frequency-modulation type in which musical tones are produced by means of frequency modulation, and said tone-color-control information includes amplitude-envelope data of musical tones and modulation control parameters for specifying harmonic components of the musical tones.

4. A musical-tone-signal-generating apparatus according to claim 1 wherein said tone-generating means is a harmonic synthesizing type in which musical tones are produced by synthesizing harmonic components of musical tones, and said tone-color-control information includes harmonic coefficients for specifying the spectrum structure of the musical tones.

5. A musical-tone-signal-generating apparatus according to claim 1 wherein said tone-generating means is a combination of two or more types of a waveform-reading type, a frequency-modulation type, and a harmonic-synthesizing type.

6. A musical tone signal-generating apparatus comprising:

(a) tone-color-designation means for designating one or more tone colors from a plurality of different tone colors, said tone-color-designation means including restriction means for restricting the number of tone colors that can be simultaneously designated to a value less than the total number of said tone colors than can be designated by said tone-color-designation means;

(b) determination means for determining a tone-color-designation state corresponding to the combination of tone colors designated by said tone-color-designation means each time said tone-color-designation means designates one ore more tone colors, and outputting state information representing the determined tone-color-designation state;

(c) storing means for storing, in advance of activation of said designation means, tone-color-control information corresponding to said tone-color-designation states, including tone color information corresponding to combined plural tone colors;

(d) reading means for reading out said tone-color-control information corresponding to said determined tone-color-designation state from said storing means by using said state information supplied for said determination means; and (e) tone-generating means for generating musical-tone signals corresponding to said determined tone-color-designation state on the basis of said tone-color-control information read from said storing means.

7. A musical-tone-signal-generating apparatus according to claim 1 wherein said tone-color-designation means is provided with a plurality of switching means, and which allows a single operation in which one of said switching means is manipulated, or a combined operation in which more than one switching means is manipulated to designate said tone colors.

8. A musical-tone-signal-generating apparatus according to claim 1 wherein said tone-color-designation means is provided with memory means that stores predetermined data for designating tone colors.

9. A musical-tone-signal-generating apparatus according to claim 1 wherein said tone-color-designation means is connected to an external apparatus that produces MIDI standard information for designating tone colors.

10. A musical-tone-signal-generating apparatus according to claim 1 wherein said tone-color-designation means is connected to an external storing means that supplies data for designating tone colors.

11. A musical-tone-signal-generating apparatus according to claim 1 wherein said tone-color-designation means designates tone colors relating to a flute coupler of an organ.

12. A musical-tone-signal-generating apparatus according to claim 1 wherein said tone-color-designation means designates tone colors relating to acoustic instruments.

13. A musical-tone-signal-generating apparatus according to claim 1 wherein said tone-color-designation means designates tone colors relating to rhythmic tones.

14. A musical tone signal generating apparatus, comprising:

means for storing a first musical waveform having a first tone color;

means for storing a second musical waveform having a second tone color;

means for storing a third musical waveform having a third mixed tone color including said first and second tone colors;

first means for designating said first tone color;

second means for designating said second tone color; and means for generating musical tones based on said stored waveforms including, means for reading out said first musical waveform in response to operation of said first means for designating, means for reading out said second musical waveform in response to operation of said second means for designating, and means for reading out said third musical waveform in response to the combined operation of said first and second means for designating.

* * * * *